United States Patent [19]

Knothe

[11] 4,144,939

[45] Mar. 20, 1979

[54] APPARATUS FOR CONVERTING CENTRIFUGAL ENERGY INTO PERCUSSIVE ENERGY

[76] Inventor: Fritz E. Knothe, Quellenturm 4, 5427 Bad Ems, Fed. Rep. of Germany

[21] Appl. No.: 772,541

[22] Filed: Feb. 28, 1977

[30] Foreign Application Priority Data

Mar. 10, 1976 [DE] Fed. Rep. of Germany ..... 2609914

[51] Int. Cl.[2] ..... B25D 9/00

[52] U.S. Cl. ..... 173/49; 173/94

[58] Field of Search ..... 173/49, 94, 95, 96, 173/97, 100, 123, 142; 74/61, 87

[56] References Cited

U.S. PATENT DOCUMENTS

| | | | |
|---|---|---|---|
| 1,094,664 | 4/1914 | Leonardi | 173/94 |
| 2,500,402 | 3/1950 | Craig | 173/94 |
| 3,486,387 | 12/1969 | Bray | 74/61 |
| 3,863,721 | 2/1975 | Scerbo et al. | 173/49 |

*Primary Examiner*—Robert A. Hafer

*Attorney, Agent, or Firm*—Robert W. Beach; Ward Brown

[57] ABSTRACT

An apparatus for converting centrifugal energy into percussive energy is operated by a motor continuously rotating a driven shaft whereby a rocking shaft is caused to oscillate about a pivot axis under the influence of the centrifugal force produced by a weight body during rotation of the driven shaft. The rocking shaft has a slot at its pivot axis and a bar extends through the slot and radially beyond opposite sides of the rocking shaft. Upon the rocking shaft oscillating in opposite directions, the opposite ends of the bar are deflected in opposite directions, so that one end of the bar urges a spring biased striker away from an anvil when the shaft rocks clockwise while the other end of the bar acts on the striker in a similar manner when the shaft rocks counter-clockwise.

11 Claims, 5 Drawing Figures

Figure 3:
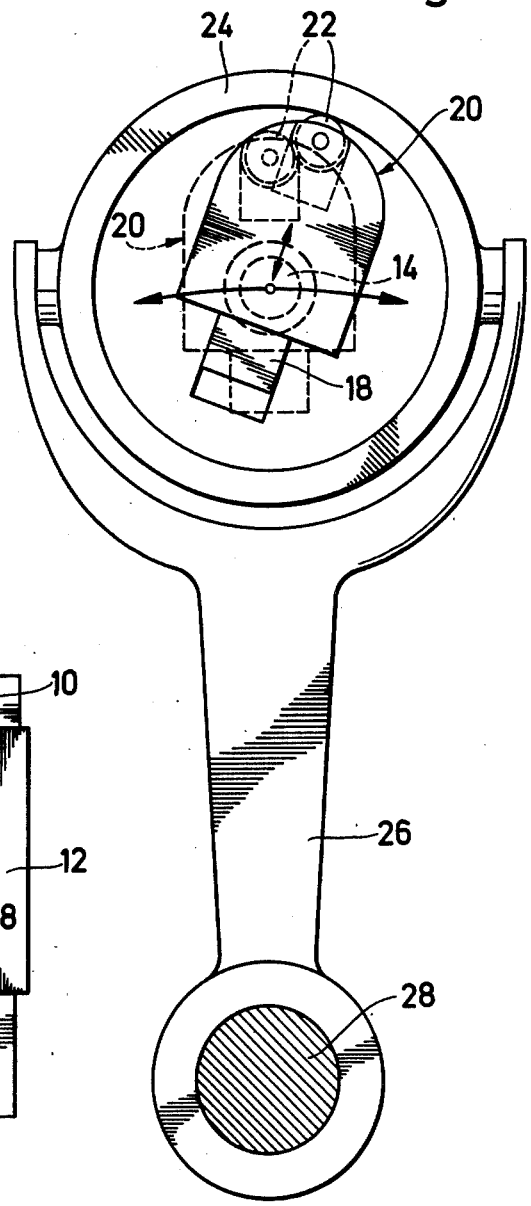

Fig. 2a
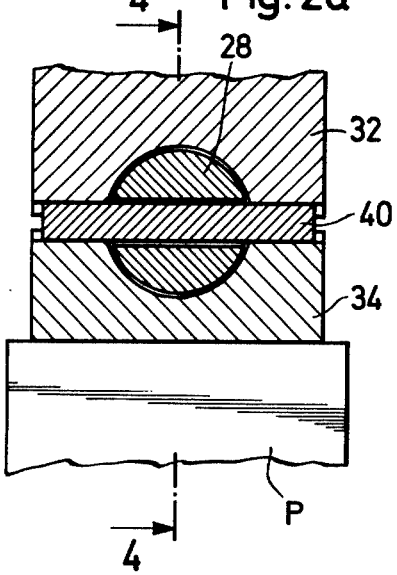
Fig. 2b
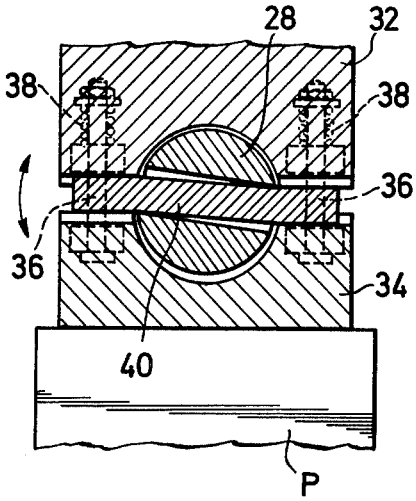
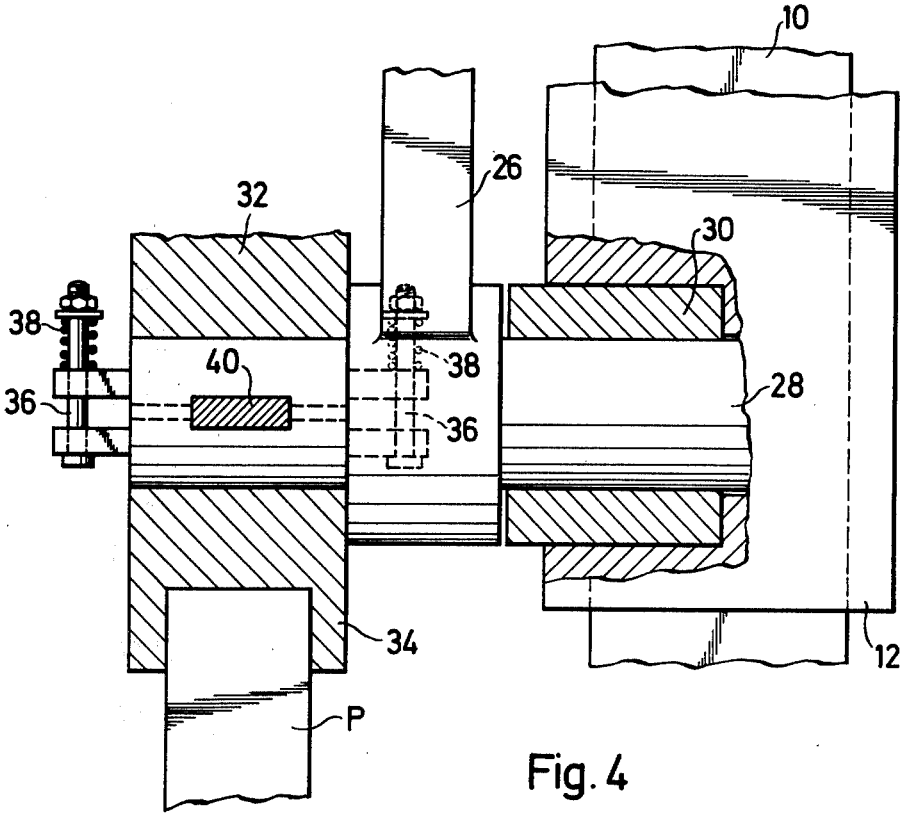
Fig. 4

APPARATUS FOR CONVERTING CENTRIFUGAL ENERGY INTO PERCUSSIVE ENERGY

The present invention relates to an apparatus for converting centrifugal energy into percussive energy, one field of application of such apparatus being a percussive tool.

It is an object of the present invention to provide an apparatus of this kind which is of relatively simple design, is efficient in operation, has a reduced noise level and is easy to maintain.

In the preferred embodiment of the invention an apparatus for converting centrifugal energy into percussive energy comprises a driven rotary shaft, a weighted body rotating with said driven shaft and movable outward radially relative to said driven shaft by centrifugal force resulting from its rotation, a rocking shaft mounted for rocking about an axis parallel to the axis of said driven rotary shaft, a lever mounted on said rocking shaft, a ring carried by said lever, spaced from said rocking shaft, having its axis extending parallel to the axes of said rocking shaft and said driven shaft, encircling said weighted body and engageable thereby when said weighted body is being moved radially relative to said driven shaft by centrifugal force resulting from its rotation for effecting rocking of said rocking shaft, said rocking shaft having a diametral slot therethrough, a bar extending through said slot and having opposite end portions projecting radially beyond opposite sides of said rocking shaft, an anvil located at one side of said projecting end portions of said bar and engageable thereby, a striker located at the opposite side of said projecting end portions of said bar and engageable thereby, and spring means urging said anvil and said striker toward each other and into engagement with said bar projecting end portions.

The apparatus according to the present invention is operated by a motor continuously rotating the driven shaft whereby the rocking shaft is caused to oscillate about its axis under the influence of the centrifugal force produced by the weighted body during rotation of the driven shaft. Upon the rocking shaft oscillating in opposite directions, diametrically opposite ends of the bar are deflected in opposite directions, so that one end of the bar urges the striker away from the anvil when the shaft rocks clockwise while the other end of the bar acts on the striker in a similar manner when the shaft rocks counterclockwise, the striker and the anvil being urged towards each other by the action of the spring means. The amount of deflection of the bar and hence of the movement of the striker away from the anvil is limited by the clearance of the bar in the aperture of the rocking shaft. The frequency of deflections of the bar is determined by the number of revolutions of the driven shaft, and it will be understood that by rotating the driven shaft fast enough to cause rapid oscillation of the pivot shaft, a percussive action of the striker is produced.

The oppositely arranged surfaces of the anvil and the striker between which the bar is clamped may be provided with recesses for receiving the rocking shaft. The surfaces of the recesses are preferably so arranged as to have a clearance relative to the surface of the rocking shaft when the rocking shaft is in its neutral position and the bar undeflected.

The apparatus according to the invention may take the form of a percussive tool which is used for driving an article into position, such as a pile driver. In this case the striker is placed onto a surface of an article and it is preferable for the apparatus to be supported as a self-contained unit on a slide which is displaceable along a stationary pillar or upright, so that the apparatus can follow the receding movement of the article.

Figure 1:
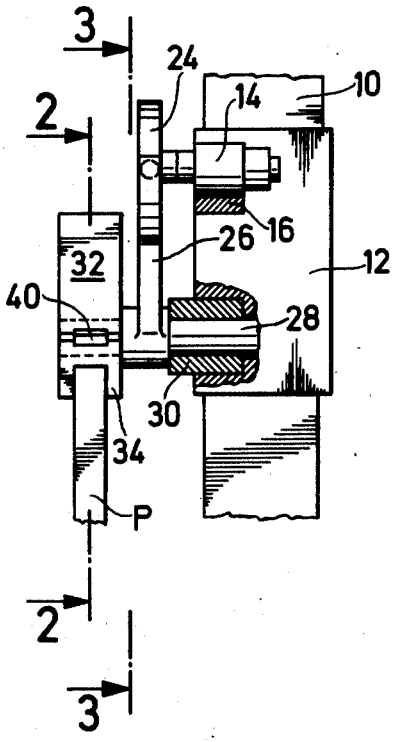

An embodiment of the invention will now be described with reference to the accompanying drawings in which FIG. 1 is an elevation, partly in section, of a pile driver incorporating the invention, FIGS. *2a* and *2b* are sections at an enlarged scale along the line 2—2 of FIG. 1 showing parts of the apparatus in different positions, FIG. 3 is a side elevation, partly in section, along the line 3—3 of FIG. 1 and FIG. 4 is a section along line 4—4 of FIG. *2a*.

The apparatus shown in the drawings comprises an upright or pillar 10 along which a slide 12 is displaceable. A shaft 14, driven by a motor (not shown), is supported in a bearing 16 on slide 12. As best seen in FIG. 3, secured to shaft 14 so as to be rotatable therewith is an arm 18 which is provided with a radial guideway. A weighted body 20 is radially displaceable in that guideway with respect to the axis of driven shaft 14. The body 20 carries at its radially outer end a roller 22 which is adapted to make contact with the inside of a ring 24. The outward and inward movement of the body 20 in the guideway of arm 18 is limited by two stops (not shown) set so as to allow the roller to contact the ring.

The ring 24 is secured to or integral with the end of a forked lever 26 secured to a rocking shaft 28. The shaft is mounted in a bearing 30 on slide 12 (FIG. 1).

Mounted at an end of shaft 28 is an anvil 32, as seen in FIG. *2a*, the anvil having at its underside a semicircular cavity for receiving the upper part of shaft 28. Arranged below the anvil is a striker 34 which has also a semicircular cavity for receiving the lower part of shaft 28. The striker 34 is suspended from the anvil 32 by bolts 36 (FIG. 4) passing through the ends of the anvil and striker and encircled by springs 38 which urge the striker 34 towards the anvil 32. A bar 40 preferably a flat spring is inserted in a diametrically extending aperture of the shaft 28, the arrangement being such that the aperture is normally parallel to the underside of anvil 32 and the top side of striker 34 (FIG. *2a*). The ends of the spring bar 40 protrude from the shaft 28 into the space between anvil and striker so that the ends of the bar are normally in contact at both their sides with the underside of the anvil 32 and the topside of the striker 34 respectively as shown in FIG. *2a*.

The anvil and the striker cavities fit over the rocking shaft with a small clearance and the bar 40 also has a small clearance in the rocking shaft aperture when the apparatus is at rest. In order to assist in the understanding of the invention these clearances are shown in the drawings as being greater than they will be in practice.

When the apparatus is in its operative position, the underside of the striker 34 rests on a pile P or any other part which is to be subjected to the impacts obtainable from the apparatus described hereinbefore.

During operation of the apparatus, the driven shaft 14 is continuously rotated and thereby also the arm 18 together with body 20. In addition, the body 20 is caused to travel radially outwards by the centrifugal force exerted on the body 20 by its rotation so that the body moves from the dotted line position in FIG. 3 to its full-line position whereby the roller 22 makes contact with the inside of ring 24. This contact is maintained during rotation of the shaft 14. It will be seen that when the body 20 is in a vertical position above the axis of shaft 28, the line of action of the centrifugal force coincides with the longitudinal axis of lever 26 and will therefore not cause the lever to rock about the axis of rocking shaft 28. However, as soon as the body 20 leaves this vertical position, the centrifugal force begins to rock lever 26 together with shaft 28 about the axis of the latter. This movement is maximum when the roller 22 is in a horizontal position. The lever 26 will therefore move like an upside-down pendulum about the axis of shaft 28, there being one full oscillation of the pendulum for each full rotation of the body 20 about the axis of shaft 24. The rocking movement of shaft 28 is imparted to the spring bar 40 which is deflected in the manner shown in FIG. 2*b* to pry the anvil 32 and the striker 34 apart as shown in FIG. 2*b* against the action of the springs 38. Every time the direction of the rocking movement of shaft 28 is reversed, the deflection of the spring bar 40 is changed as well. This brings about a rapid succession of relative spreading and impacting movements of the striker 34 and the anvil 32, with the striker hitting the anvil each time with considerable impact and the anvil transmitting to bouncing back from it the pile P the same force.

In order to obtain a rapid succession of blows from the striker, the angular deflection of the spring bar 40; and hence the rocking movement of shaft 28 and the radial displacement of the weighted body; must be very small and in actual fact may be smaller than indicated in the drawings.

In the embodiment of the apparatus according to the invention, the energy of the centrifugal force acting on body 20 is therefore converted into the percussive energy of striker 34.

It will be clear that the invention is capable of various modifications and can be applied to other forms of apparatus than that shown and described here.

I claim:

1. Apparatus for converting centrifugal energy into percussive energy comprising a driven rotary shaft, a weighted body rotating with said driven shaft and movable outward radially relative to said driven shaft by centrifugal force resulting from its rotation, a rocking shaft mounted for rocking about an axis parallel to the axis of said driven rotary shaft, a lever mounted on said rocking shaft, a ring carried by said level, spaced from said rocking shaft, having its axis extending parallel to the axes of said rocking shaft and said driven shaft, encircling said weighted body and engageable thereby when said weighted body is being moved radially relative to said driven shaft by centrifugal force resulting from its rotation for effecting rocking of said rocking shaft, said rocking shaft having a diametral slot therethrough, a bar extending through said slot and having opposite end portions projecting radially beyond opposite sides of said rocking shaft, an anvil located at one side of said projecting end portions of said bar and engageable thereby, a striker located at the opposite side of said projecting end portions of said bar and engageable thereby, and spring means urging said anvil and said striker toward each other and into engagement with said bar projecting end portions.

2. The apparatus defined in claim 1, including a post and means supporting the driven rotary shaft and the rocking shaft for displacement along said post.

3. A percussive tool comprising:

a striker;

an anvil located opposite said striker, movable to impact said striker and movable away from said striker;

means for biasing said anvil toward said striker; and means for moving said anvil and said striker periodically away from one another in opposition to said biasing means, said moving means including spreading means located between said anvil and said striker and engageable with said anvil and said striker and drive means for periodically moving said spreading means relative to said striker and said anvil for prying said striker and said anvil away from each other.

4. The tool defined in claim 3, in which the spreading means includes a bar normally clamped between the anvil and striker by the biasing means.

5. A percussive tool comprising:

a striker;

an anvil located opposite said striker, movable to impact said striker and movable away from said striker;

means for biasing said anvil toward said striker; and means for moving said anvil and said striker periodically away from one another in opposition to said biasing means, said moving means including spreading means between the anvil and striker for moving the striker and anvil periodically away from one another, a rocking shaft connected to the spreading means and oscillating means for rocking said rocking shaft to move the spreading means.

6. The tool defined in claim 5, in which the anvil and striker form a cavity receiving the rocking shaft and the spreading means extends across said cavity.

7. The tool defined in claim 5, in which the oscillating means include a lever connected to the rocking shaft, and means for rocking said lever.

8. The tool defined in claim 7, in which the lever rocking means include a ring carried by the lever, a driven shaft and a weighted body carried inside said ring by said driven shaft, rotatable by said driven shaft and radially displaceable relative thereto to engage said ring.

9. The tool defined in claim 5, in which the spreading means includes a bar normally clamped between the anvil and striker by the biasing means.

10. The tool defined in claim 5, in which the oscillating means include a lever connected to the rocking shaft, an abutment ring carried by said lever, a driven shaft and a weighted body carried inside said ring by said driven shaft, rotatable by said driven shaft and radially displaceable relative thereto to engage said ring.

11. Apparatus comprising a rocking shaft, a lever connected to said rocking shaft and extending outwardly therefrom; a ring carried by said lever, spaced from said rocking shaft and having its axis extending generally parallel to the rocking shaft axis; a driven rotary shaft; and a weighted body carried inside said ring by said driven rotary shaft, rotatable thereby and radially displaceable relative thereto by centrifugal force resulting from its rotation to engage said ring to displace it for rocking said lever and said rocking shaft.

* * * * *

UNITED STATES PATENT AND TRADEMARK OFFICE

CERTIFICATE OF CORRECTION

PATENT NO. : 4,144,939

DATED : March 20, 1979

INVENTOR(S) : Fritz E. Knothe

It is certified that error appears in the above-identified patent and that said Letters Patent are hereby corrected as shown below:

Title page, [56] References Cited, after "Bray" insert --Jr.--.

Column 3, line 51, cancel "level" and insert --lever--.

Signed and Sealed this

*Twenty-fourth* Day of *July 1979*

[SEAL]

*Attest:*

*Attesting Officer*

LUTRELLE F. PARKER

*Acting Commissioner of Patents and Trademarks*